US005577302A

United States Patent [19]

Bortle

[11] Patent Number: 5,577,302

[45] Date of Patent: Nov. 26, 1996

[54] NECKTIE FASTENING DEVICE

[76] Inventor: Wesley A. Bortle, 77 Catamaran La., Shalimar, Fla. 32579-1307

[21] Appl. No.: 508,583

[22] Filed: Jul. 28, 1995

[51] Int. Cl.[6] ..... A41D 25/00; A44B 18/00

[52] U.S. Cl. ..... 24/49.1; 24/65; 24/306; 24/DIG. 11; 2/150

[58] Field of Search ..... 24/49.1, 64, 65, 24/306; 2/145, 150, 153

[56] References Cited

U.S. PATENT DOCUMENTS

| | | | |
|---|---|---|---|
| 3,517,395 | 6/1970 | Shimoi | 2/153 |
| 3,735,420 | 5/1973 | New | 2/150 |
| 3,942,191 | 3/1976 | Hunnicutt | 2/145 |
| 3,964,105 | 6/1976 | Gideon | 24/49.1 |
| 4,420,519 | 12/1983 | Slemmons | 24/DIG. 11 |
| 4,513,453 | 4/1985 | Chen et al. | 2/150 |
| 4,827,536 | 5/1989 | Sung | 2/145 |
| 4,862,563 | 9/1989 | Flynn | 24/306 |
| 4,875,239 | 10/1989 | Patterson, Jr. | 2/152 R |
| 4,995,118 | 2/1991 | Paduano, Sr. | 2/150 |
| 5,048,122 | 9/1991 | Yang | 2/149 |
| 5,432,953 | 7/1995 | Kim | 2/150 |

*Primary Examiner*—Victor N. Sakran
*Attorney, Agent, or Firm*—Joseph N. Breaux

[57] ABSTRACT

A necktie fastening device including a pair of securing members that are attachable to the severed, central ends of a conventional necktie that has been severed in half with a pair of scissors or the like. Each securing member is formed from a flexible material that has been formed to create a first, second, and third flap member. The first and second flap members each have a quantity of adhesive deposited on areas thereof that face away from one another and which are covered with a flexible removable section of cover material. An elongated flexible pull tab is secured to each removable section. In use, the adhesive is placed in contact with the interior surface of the tie through the severed central end and forms an attachment between the necktie fabric and the securing member with the central lining of the necktie disposed between the first and second flap members. The third flap member includes either a section of hook material from a hook and pile type fastener or a section of pile material from a hook and pile type fastener that is secured to one side thereof. The other side of the third flap may be adapted to display advertising indicia if desired such as the name and location of a store or clothing manufacturer.

8 Claims, 6 Drawing Sheets

NECKTIE FASTENING DEVICE

TECHNICAL FIELD

The present invention relates to devices for securing a necktie about the neck of a user and more particularly to devices for converting conventional neckties into neckties that may be secured about the neck of a user without the necessity of tieing the tie each time it is worn.

BACKGROUND ART

Learning to tie a necktie can be difficult for many adolescents and children. Because of this difficulty, parents often resort to tieing the child's necktie each time it is worn or purchasing clip-on neckties for the child that clip onto the front of the collar at the center of the throat of the wearer. These clip-on neckties often are only available in a limited variety of styles and collars and are often unappealing to the youthful wearer. It would be a benefit to these youthful wearers to have a device for converting a conventional tie-type necktie into a tie-once necktie that is securable about the neck of the wearer with an easily utilized fastening device. It would be a further benefit if the conversion could be accomplished using only readily available tools such as shears or scissors.

It would also be a benefit in aiding merchants in maintaining a diverse necktie inventory to have a device available for sale that allowed customers to easily convert a conventional tie-type necktie into a tie-once necktie that is securable about the neck of the wearer with a fastening device. It would be a further benefit to these merchants if the fastening device included an area visible to the wearer of the necktie during donning of the necktie that was suitable for displaying an advertising message. It would be a still further benefit if the securing device was easily constructed from inexpensive, light-weight materials.

GENERAL SUMMARY DISCUSSION OF INVENTION

It is thus an object of the invention to provide a fastening device securable to a conventional necktie to convert the necktie into a tie-once necktie.

It is a further object to provide a fastening device for a tie-once necktie that has a fastening mechanism easily utilized by adolescents and small children.

It is a further object of the invention to provide a necktie fastening device that required only readily available shears or scissors to convert a conventional necktie into a tie-once necktie.

It is a still further object of the invention to provide a necktie fastening device that provides an area visible to the wearier of the necktie during donning of the necktie suitable for displaying an advertising message.

It is a still further object of the invention to provide a necktie fastening device that is easily constructed from inexpensive, light-weight materials.

It is a still further object of the invention to provide a necktie fastening device that accomplishes some or all of the aforementioned objectives.

Accordingly, a necktie fastening device is provided. The fastening device includes a pair of securing members that are attachable to the severed, central ends of a conventional necktie that has been severed in half with a pair of scissors or the like. Each securing member is formed from a flexible material that has been formed to create a first, second, and third flap member. The first and second flap members each have a quantity of adhesive deposited on areas thereof that face away from one another and which are covered with a flexible removable section of material. An elongated flexible pull tab is secured to each removable section. In use, the adhesive is placed in contact with the interior surface of the tie through the severed central end and forms an attachment between the necktie fabric and the securing member with the central lining of the necktie disposed between the first and second flap members.

The third flap member includes either a section of hook material from a hook and pile type fastener or a section of pile material from a hook and pile type fastener that is secured to one side thereof. The other side of the third flap may be adapted to display advertising indicia if desired such as the name and location of a store or clothing manufacturer.

The securing member is preferably constructed from an elongated strip of flexible plastic material that has been bent in half and the sections adjacent the bend adhesively secured together to form the first, second and third flap members. The securing member is also preferably constructed from two elongated strips of flexible plastic material that have been adhesively secured together along about one-half the length thereof to form the first, second, and third flap members.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
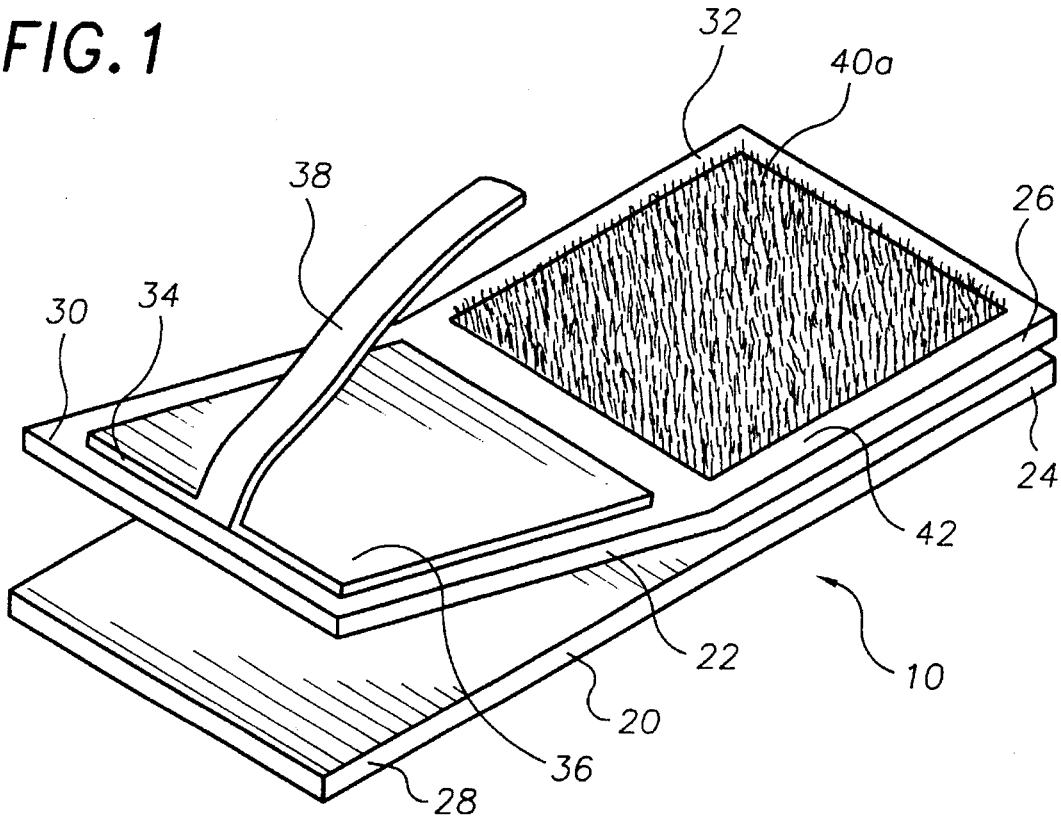
FIG. 1 is a perspective view of an exemplary embodiment of one of the securing members of the necktie fastening device of the present invention.
Figure 1A:
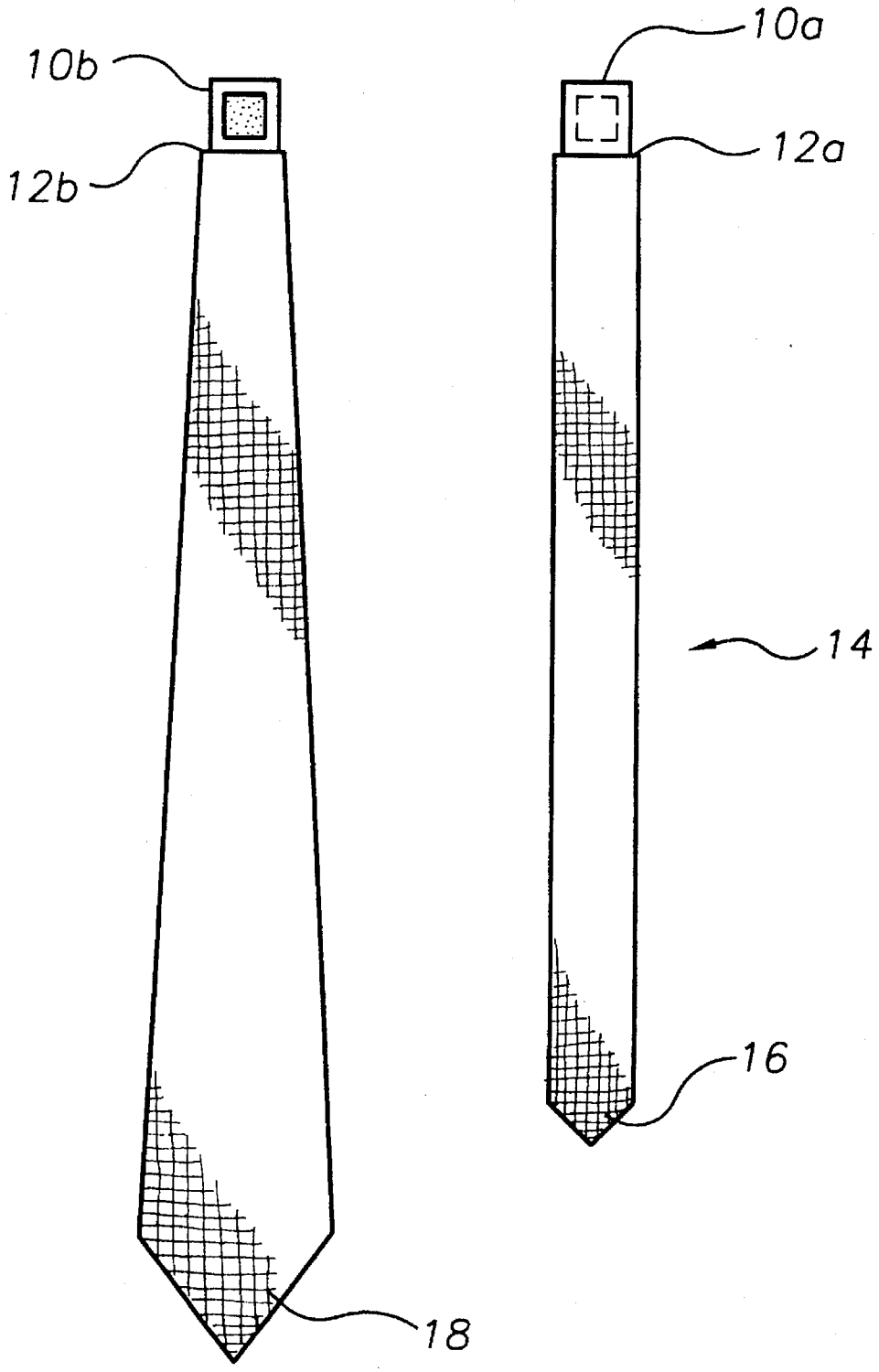
FIG. 1A is a side view of the representative necktie with a pair of securing members installed.

FIG. 1 shows an exemplary embodiment of one securing member 10 of the fastening device of the present invention. As discussed herein before, the fastening device of the present invention includes a pair of securing members 10*a*,10*b* that are attachable, as shown in FIG. 1A, to the severed, central ends 12*a*,12*b* of a conventional necktie, generally referenced by the numeral 14, that has been severed intermediate ends 16,18.

With reference once again to FIG. 1, each securing member 10 is formed from pair of elongated, flexible members 20,22. Flexible members 20,22 are bonded together along about half their lengths from ends 24,26 respectively to create a first 28, second 30, and third 32 flap member.

First and second flap members 28,30 each have a quantity of adhesive 34 (only one quantity shown in FIG. 1) deposited on areas thereof that face away from one another and which are covered with a flexible removable section 36 (only one shown in FIG. 1) of material. An elongated flexible pull tab 38 is secured to each removable section 36.

Figure 2:
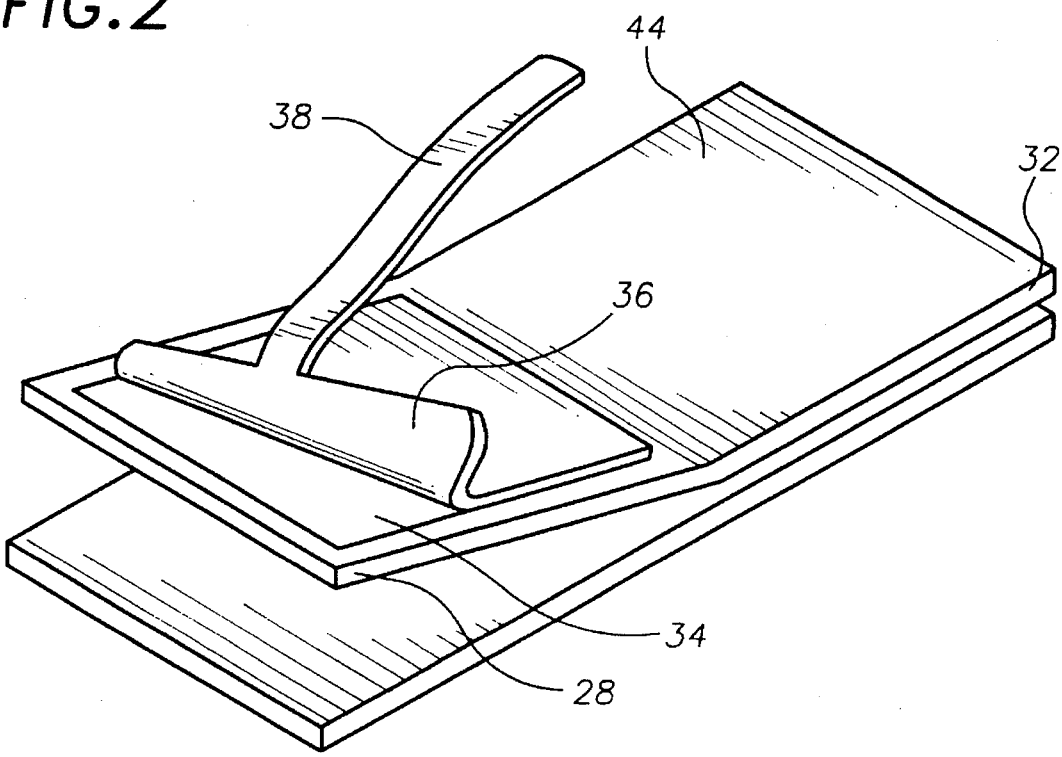
FIG. 2 is a perspective View of a second side of the securing member of FIG. 1.

Third flap member 32 includes either a section of hook material 40*a* from a hook and pile type fastener or a section of pile material 40*b* from a hook and pile type fastener that is secured to one side surface 42 thereof. FIG. 2 shows the other side surface 44 of third flap member 32. In this embodiment, other side surface 44 is adapted to receive and display an advertising display sticker including the name and location of a store or clothing manufacturer. FIG. 2 also more clearly shows first flap members 28 and the quantity of adhesive 34 which is covered with a flexible removable section 36. In this figure, removable section 36 is partially peeled away from adhesive 34 utilizing elongated flexible pull tab 38.

Figure 4:
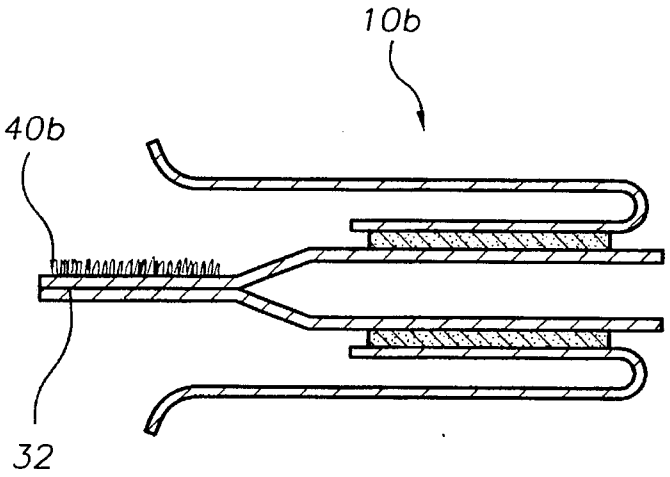
FIG. 4 is a side view of a companion securing member of the securing member shown in FIG. 3 having a section of hook material for interconnecting with the pile material of the embodiment of FIG. 3.
Figure 3:
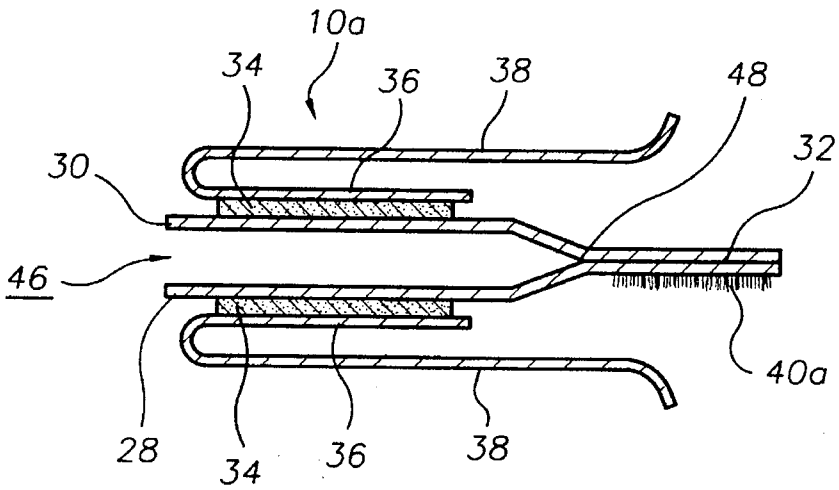
FIG. 3 is a side view of an exemplary embodiment of a securing member having a section of pile material.

FIG. 3 is a side view of a securing member 10*a* having a section of hook material 40*a* attached to third flap member 32. As shown in the figure, a gap 46 is formed between first and second flap members 28,30. Gap 46 holds a section of necktie lining material when securing member 10*a* is connected with a necktie. In this embodiment, both elongated pull tabs 38 extend past the connection point 48 between first and second flap members 28,30 about midway along and into third flap member 32. Extending elongated pull tabs to this position allows removable sections 36 to be removed from adhesive 34 once flap members 28,30 are in position during installation. FIG. 4 shows a second securing member 10*b* identical in all respects with the securing member 10*a* shown in FIG. 3 except flap members 28, 30, 32 are designated fourth, fifth and sixth flap members, respectively, and securing member 10*b* has a section of pile material 40*b* attached to sixth flap member 32. The necktie securing device of the present invention includes one each securing member 10*a* and 10*b*.

Figure 5:
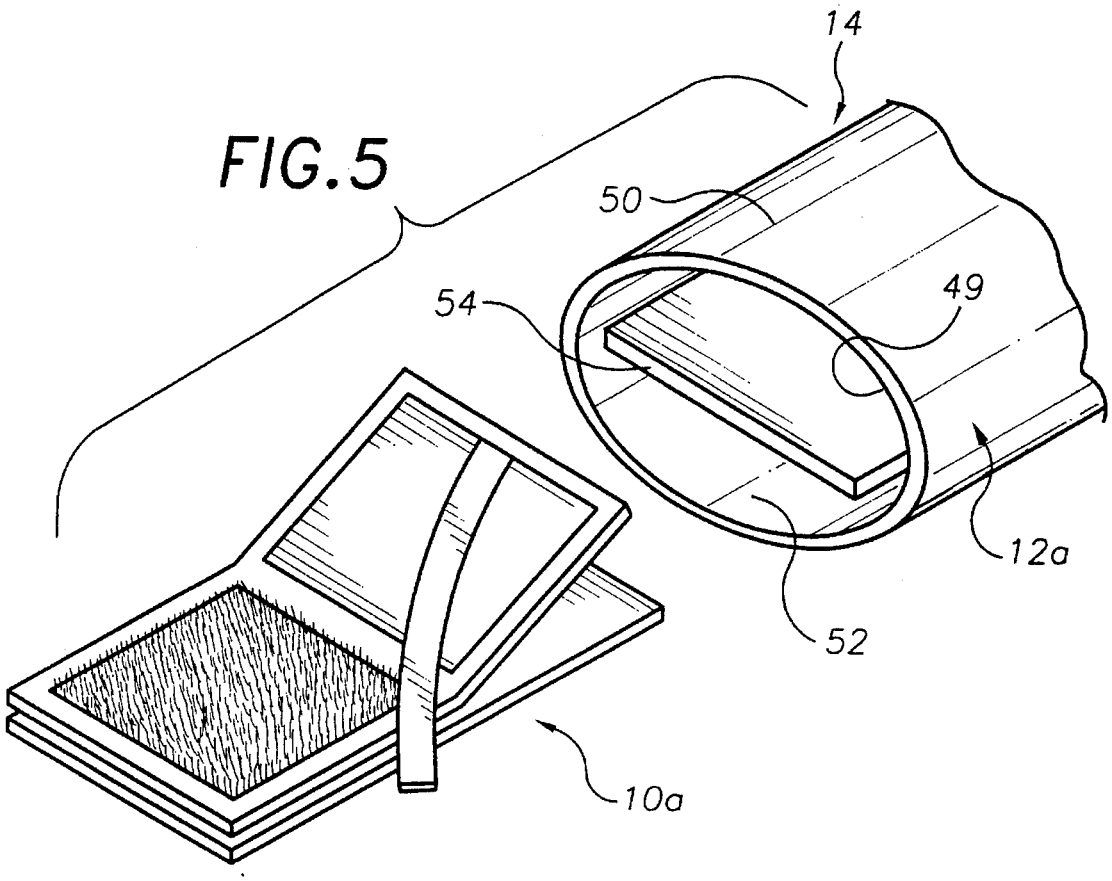
FIG. 5 is an exploded view of a representative necktie with a securing member prior to connection of the securing member to the necktie.
Figure 6:
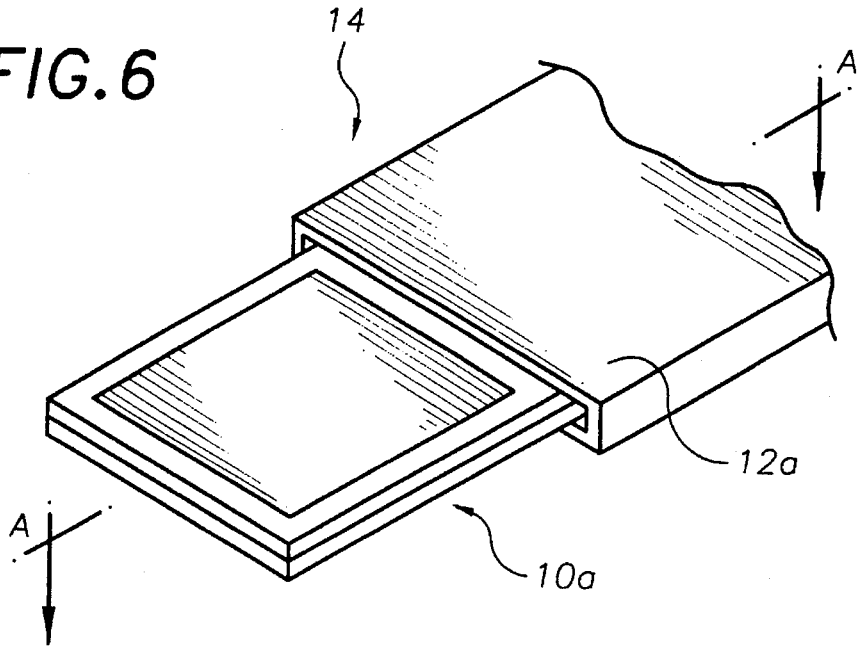
FIG. 6 is a perspective view of a securing member in connection with/one half of the representative necktie.

FIG. 5 shows securing member 10*a* adjacent to severed, central end 12*a* of conventional necktie 14 (previously shown in FIG. 1A) prior to forming a connection between securing member 10*a* and central end 12*a*. As shown in the figure, central end 12*a* includes a perimeter lip 49 defining a transition between an exterior necktie surface 50 and an interior necktie surface 52; and a section of necktie lining material 54. FIG. 6 is a detail view of securing member 10*a* in connection with severed, central end 12*a* of conventional necktie 14.

Figure 7:
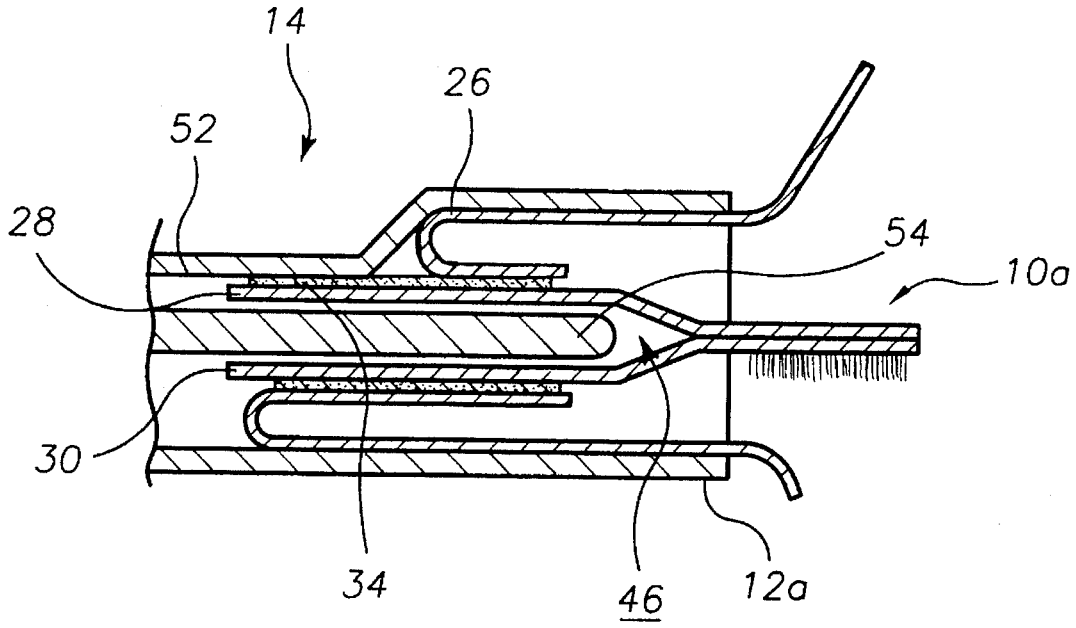
FIG. 7 is a cross-section of the securing member and necktie of FIG. 6 along the line A—A showing the securing member installed within the necktie with one of the adhesive covering members partially pulled away from the adhesive.
Figure 8:
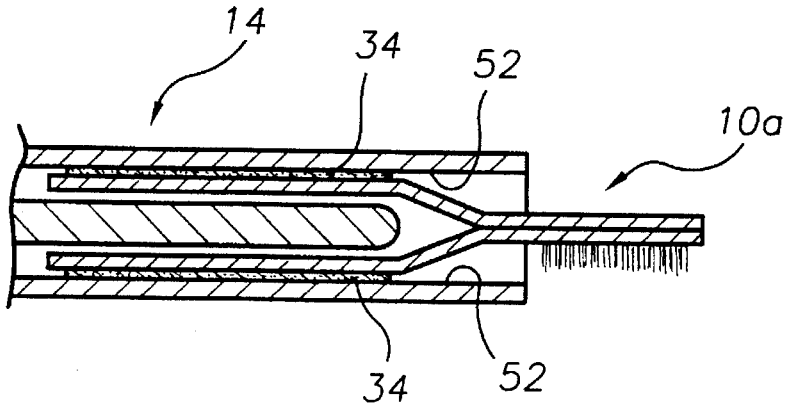
FIG. 8 is a cross-section of the securing member and necktie of FIG. 6 along the line A—A showing the securing member installed within the necktie with both of the adhesive covering members removed from the adhesive.

FIG. 7, a cross-sectional view of a securing member 10*a* partially connected with a conventional necktie 14, shows first and second flaps 28,30 of securing member 10*a* installed within central end 12*a* of conventional necktie 14. Section 54 of the necktie lining material is disposed within gap 46 and a portion of one of sections 26 has been peeled away allowing adhesive 34 to form a bond with interior necktie surface 52 of conventional necktie 14. As shown in the figure having elongated pull tabs 38 allows first and second flap members 28,30 to be fully inserted within central end 12*a* of conventional necktie 14 before removing sections 26 of cover material from adhesive 34 and thereby prevents premature attachment between securing member 10*a* and interior necktie surface 52. Forming the connection between necktie 14 and securing member 10 interiorly of neck tie 14 minimizes the length of the necktie fastening device that shows during use and minimizes the unsightly collection of lint and other foreign material visibly clinging to inadvertently exposed adhesive surfaces 34. FIG. 8 is a cross-sectional view of securing member 10*a* completely connected with conventional necktie 14 and both adhesive sections 34 adhesively bonded to interior necktie surface 52.

Figure 9:
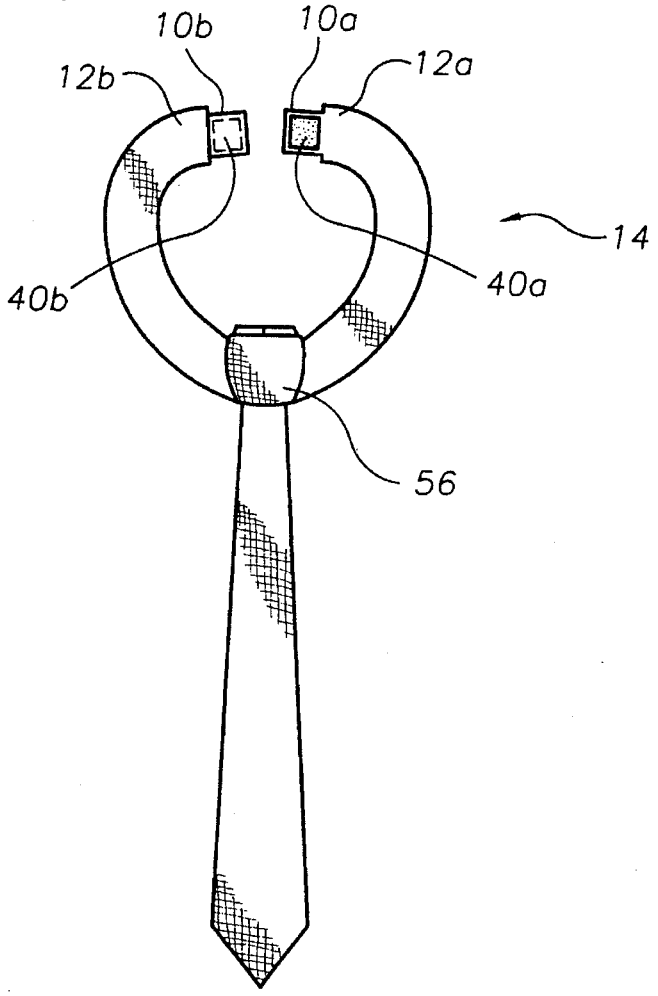
FIG. 9 is a side view of the necktie of FIG. 9 tied in a wearing configuration ready for securing about the neck of a user.

FIG. 9 shows a pair of securing members 10*a*,10*b* secured to central ends 12*a*,12*b* of conventional necktie 14. In this figure necktie 14 has been tied in a conventional Windsor type knot 56 and is ready for attachment about the neck of a wearer by contacting section 40*a* of hook material with section 40*b* of pile material. Because knot 56 is a conventional type knot, necktie 14 is adjustable about the neck of a wearer in the conventional manner.

Figure 10:
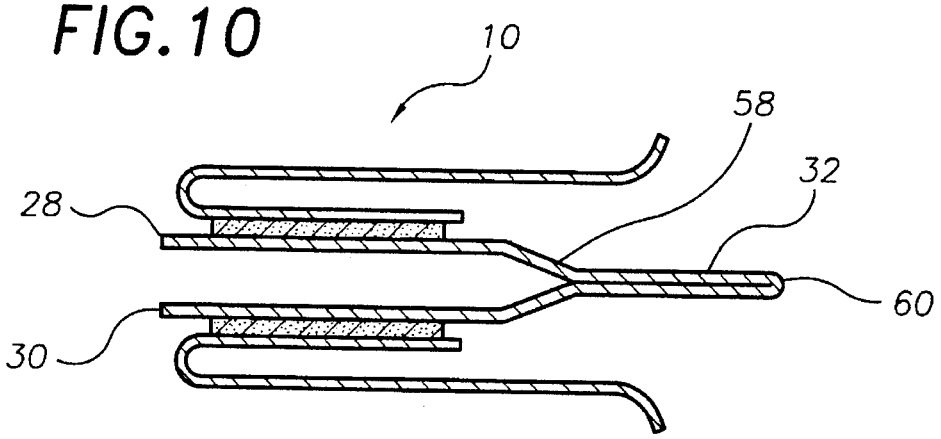
FIG. 10 is a side view of a second embodiment of a securing member showing a second preferred construction configuration.

FIG. 10 shows an alternative construction configuration for securing member 10. In this configuration securing member 10 is constructed from a single elongated strip 58 of flexible plastic material that has been bent in half and the sections adjacent the bend 60 adhesively secured together to form first, second and third flap members 28,30,32.

It can be seen from the preceding description that a fastening device that is securable to a conventional necktie to convert the necktie into a tie-once necktie; that has a fastening mechanism easily utilized by adolescents and small children; that requires only readily available shears or scissors to convert a conventional necktie into a tie-once necktie; that provides an area visible to the wearier of the necktie during donning of the necktie suitable for displaying an advertising message; and that is easily constructed from inexpensive, light-weight materials has been provided.

It is noted that the embodiment of the necktie fastening device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A necktie fastening device comprising:

a first securing member including a first flap member, a second flap member, and a third flap member; said first flap member having a first quantity of adhesive deposited on a first area thereof covered with a first removable section of cover material, said second flap member having a second quantity of adhesive deposited on a second area thereof covered with a second removable section of cover material, said third flap member having a section of hook material from a hook and pile type fastener attached thereto; and a second securing member including a fourth flap member, a fifth flap member, and a sixth flap member; said fourth flap member having a third quantity of adhesive deposited on a third area thereof covered with a third removable section of cover material, said fifth flap member having a fourth quantity of adhesive deposited on a fourth area thereof covered with a fourth removable section of cover material, said sixth flap member having a section of pile material from a hook and pile type fastener attached thereto;

said section of hook material and said section of pile material forming an attachment when pressed into contact with one another, a first elongated flexible pull tab being secured to said first removable section of cover material;

a second elongated flexible pull tab being secured to said second removable section of cover material;

a third elongated flexible pull tab being secured to said third removable section of cover material; and a fourth elongated flexible pull tab being secured to said fourth removable section of cover material.

2. The necktie fastening device of claim 1 wherein:

each of said first, second, third and fourth elongated pull tabs is of a length longer than said section of removable cover material to which said pull tab is attached.

3. A necktie fastening device comprising:

a first securing member including a first flap member, a second flap member, and a third flap member; said first flap member having a first quantity of adhesive deposited on a first area thereof covered with a first removable section of cover material, said second flap member having a second quantity of adhesive deposited on a second area thereof covered with a second removable section of cover material, said third flap member having a section of hook material from a hook and pile type fastener attached thereto; and a second securing member including a fourth flap member, a fifth flap member, and a sixth flap member; said fourth flap member having a third quantity of adhesive deposited on a third area thereof covered with a third removable section of cover material, said fifth flap member having a fourth quantity of adhesive deposited on a fourth area thereof covered with a fourth removable section of cover material, said sixth flap member having a section of pile material from a hook and pile type fastener attached thereto;

said section of hook material and said section of pile material forming an attachment when pressed into contact with one another, said first securing member being constructed from an first elongated strip of flexible plastic material that has been bent in half and sections adjacent to said bend bonded together to form said first, second and third flap members;

said second securing member being constructed from an second elongated strip of flexible plastic material that has been bent in half and sections adjacent to said bend bonded together to form said fourth, fifth, and sixth flap members.

4. The necktie fastening device of claim 6, wherein:

a third flap side surface of said third flap member is adapted to receive advertising indicia thereon.

5. The necktie fastening device of claim 4, wherein:

a first elongated flexible pull tab is secured to said first removable section of cover material;

a second elongated flexible pull tab is secured to said second removable section of cover material;

a third elongated flexible pull tab is secured to said third removable section of cover material; and a fourth elongated flexible pull tab is secured to said fourth removable section of cover material.

6. A necktie fastening device comprising:

a first securing member including a first flap member, a second flap member, and a third flap member; said first flap member having a first quantity of adhesive deposited on a first area thereof covered with a first removable section of cover material, said second flap member having a second quantity of adhesive deposited on a second area thereof covered with a second removable section of cover material, said third flap member having a section of hook material from a hook and pile type fastener attached thereto; and a second securing member including a fourth flap member, a fifth flap member, and a sixth flap member; said fourth flap member having a third quantity of adhesive deposited on a third area thereof covered with a third removable section of cover material, said fifth flap member having a fourth quantity of adhesive deposited on a fourth area thereof covered with a fourth removable section of cover material, said sixth flap member having a section of pile material from a hook and pile type fastener attached thereto;

said section of hook material and said section of pile material forming an attachment when pressed into contact with one another, said first securing member being constructed from a first and a second elongated strip of flexible plastic material that has been bonded together along at least a quarter of the length thereof to form said first, second and third flap members; and said second securing member being constructed from a third and a fourth elongated strip of flexible plastic material that has been bonded together along at least a quarter of the length thereof to form said fourth, fifth, and sixth flap members.

7. The necktie fastening device of claim 6, wherein:

a first elongated flexible pull tab is secured to said first removable section of cover material;

a second elongated flexible pull tab is secured to said second removable section of cover material;

a third elongated flexible pull tab is secured to said third removable section of cover material; and a fourth elongated flexible pull tab is secured to said fourth removable section of cover material.

8. The necktie fastening device of claim 7, wherein:

a third flap side surface of said third flap member is adapted to receive advertising indicia thereon.

* * * * *